US006189156B1

(12) United States Patent
Loiars

(10) Patent No.: US 6,189,156 B1
(45) Date of Patent: Feb. 20, 2001

(54) CATCHER'S HELMET WITH EYE SHIELD

(75) Inventor: John T. Loiars, West Hartford, CT (US)

(73) Assignee: Spalding Sports Worldwide, Inc.

( * ) Notice: Under 35 U.S.C. 154(b), the term of this patent shall be extended for 0 days.

(21) Appl. No.: 09/359,060

(22) Filed: Jul. 21, 1999

(51) Int. Cl.[7] ..... A42B 3/18
(52) U.S. Cl. ..... 2/424; 2/425; 2/9
(58) Field of Search ..... 2/9, 424, 425, 2/15, 410, 411, 417

(56) References Cited

U.S. PATENT DOCUMENTS

| | | | | |
|---|---|---|---|---|
| 3,373,443 | * | 3/1968 | Marietta | 2/9 |
| 3,729,745 | | 5/1973 | Latina . | |
| 3,732,574 | * | 5/1973 | Hale | 2/9 |
| 4,021,858 | * | 5/1977 | Neeld et al. | 2/9 |
| 4,031,564 | * | 6/1977 | Wood | 2/9 |
| 4,736,466 | * | 4/1988 | Kallstrom | 2/9 |
| 5,129,108 | | 7/1992 | Copeland . | |
| 5,483,699 | | 1/1996 | Pernicka . | |
| 5,815,848 | * | 10/1998 | Jarvis | 2/424 |
| 5,953,761 | * | 9/1999 | Jurga et al. | 2/425 |

* cited by examiner

*Primary Examiner*—Michael A. Neas

(57) ABSTRACT

A catcher's helmet is provided with a front portion including a top extent and a pair of side extents. The front extent forms a face opening there between. Also included is a rear portion. At least one strap is mounted between the front portion and rear portion. A transparent shield is positioned over the face opening.

1 Claim, 4 Drawing Sheets

CATCHER'S HELMET WITH EYE SHIELD

BACKGROUND OF THE INVENTION

1. Field of the Invention

The present invention relates to a catcher's helmet with eye shield and more particularly pertains to providing a helmet with separate front and rear portions coupled by way of a strap assembly and with a transparent eye shield over this front portion.

2. Description of the Prior Art

The use of athletic headgear is known in the prior art. More specifically, athletic headgear heretofore devised and utilized for the purpose of protecting a head of a player are known to consist basically of familiar, expected and obvious structural configurations, notwithstanding the myriad of designs encompassed by the crowded prior art which have been developed for the fulfillment of countless objectives and requirements.

By way of example, the prior art includes U.S. Pat. No. 3,729,745; U.S. Pat. No. 5,129,108; and U.S. Pat. No. 5,483,699. Each of the forgoing helmets include merely a mask which is connected to a rear head-encompassing portion by way of an abutting coupling.

In this respect, the catcher's helmet according to the present invention substantially departs from the conventional concepts and designs of the prior art, and in so doing provides an apparatus primarily developed for the purpose of providing a helmet with separate front and rear portions coupled by way of a strap assembly with an associated shield.

Therefore, it can be appreciated that there exists a continuing need for a new and improved catcher's helmet which can be used for providing a helmet with separate front and rear portions coupled by way of a strap assembly with an associated shield. In this regard, the present invention substantially fulfills this need.

SUMMARY OF THE INVENTION

In view of the foregoing disadvantages inherent in the known types of athletic headgear now present in the prior art, the present invention provides an improved catcher's helmet. As such, the general purpose of the present invention, which will be described subsequently in greater detail, is to provide a new and improved catcher's helmet which has all the advantages of the prior art and none of the disadvantages.

To attain this, the present invention essentially comprises a rigid unitary front portion having a top extent. As shown in FIGS. 1 through 3, the top extent is defined by a quarter of an ellipsoid. A pair of parallel rows of linearly aligned breathing apertures are formed in the top extent between a front end and a rear end thereof. The unitary front portion further includes a pair of generally planar and square side extents. The side extents are integrally coupled to opposite sides of a rear half of a lower peripheral edge of the top extent and depend downwardly therefrom. Each side extent includes a pair of vertically oriented apertures formed therein, as shown in FIG. 2. The side extents each have an outwardly extending lip formed along a rear edge thereof. See FIG. 3. A front extent of the unitary front portion has a pair of ends integrally coupled to lower front corners of the side extents. The front extent is defined by a top peripheral edge which resides in a plane extending forwardly and downwardly from the side extents. A lower peripheral edge of the front extent forms a smooth arcuate transition with that of the side extents. The front extent has a forwardly extending lip and a plurality of breathing apertures formed therein with a face opening located between the top extent, side extents and front extent. As shown in FIGS. 2 and 3, the rear edges of the side extents reside in a vertical plane common to that which contains a rear edge of the top extent. Next provided is a face plate including a pair of horizontally oriented upper U-shaped bars. Each of such upper U-shaped bars has ends mounted to tops of front edges of the side extents of the unitary front portion. The upper U-shaped bars are maintained in parallel relationship with each other via a front connector bar, as shown in FIG. 1. A plurality of additional lower U-shaped bars each have ends coupled to bottoms of the front edges of the side extents of the front portion at a common position. As such, the additional lower U-shaped bars extend therefrom at various angles between a horizontal plane and that associated with the top peripheral edge of the front extent of the unitary front portion. A pair of generally vertical side bars are coupled along opposite sides of the upper and lower U-shaped bars. Furthermore, an inverted vertically oriented U-shaped bar is mounted to the lower U-shaped bars. Also included is a rear portion having an arcuate rear face and a peripheral side wall coupled to the rear face and extended forwardly therefrom. By this structure, the rear portion defines an open bottom and a front peripheral edge which resides in a vertical plane. A strap assembly includes a plurality of horizontally oriented adjustable straps mounted between slots formed in a top extent of the unitary front portion and the rear portion. A pair of angled adjustable straps include a first angled strap having ends coupled within angle slots in the front lower corners of the side extents of the front portion. As such, the first angled strap may be wrapped about a rear neck area of a user. A second angled strap of the strap assembly has a pair of ends coupled within angled slots formed in the peripheral side wall of the rear portion. The second angled strap is slidably situated within angled slots formed in the front lower corners of the side extents. A chin holster is coupled to the second angled strap and is further situated within the helmet adjacent the front extent of the unitary front portion. A shield is positioned over the upper extent of the face opening of the mask to cover the majority of the area thereof. This position of the shield includes the area between the side extents and from the top extent to a location adjacent to but above the front extent. The shield is fabricated of a rigid transparent plastic material with vertical slots adjacent to its lateral ends for the receipt of coupling straps. The shield also includes an upward, inwardly angled joining region, the joining region being formed with a plurality of small openings to define a plurality of reception rods along the upper extent. Straps encompass the rods for joining the rods and the shield to the mask through fasteners.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved catcher's helmet which has all the advantages of the prior art athletic headgear and none of the disadvantages.

It is another object of the present invention to provide a new and improved catcher's helmet which may be easily and efficiently manufactured and marketed.

It is a further object of the present invention to provide a new and improved catcher's helmet which is of a durable and reliable construction.

An even further object of the present invention is to provide a new and improved catcher's helmet which is susceptible of a low cost of manufacture with regard to both materials and labor, and which accordingly is then susceptible of low prices of sale to the consuming public, thereby making such catcher's helmet economically available to the buying public.

Still yet another object of the present invention is to provide a new and improved catcher's helmet which provides in the apparatuses and methods of the prior art some of the advantages thereof, while simultaneously overcoming some of the disadvantages normally associated therewith.

Still another object of the present invention is to providing a helmet with separate front and rear portions coupled by way of a strap assembly and with a transparent eye shield over this front portion.

Lastly, it is an object of the present invention to provide a new and improved catcher's helmet including a front portion with a top extent and a pair of side extents. The front extent forms a face opening there between. Also included is a rear portion. At least one strap is mounted between the front portion and rear portion. A transparent shield is positioned over the face opening.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

Similar reference characters refer to similar parts throughout the several views of the drawings.

DESCRIPTION OF THE PREFERRED EMBODIMENT

Figure 1:
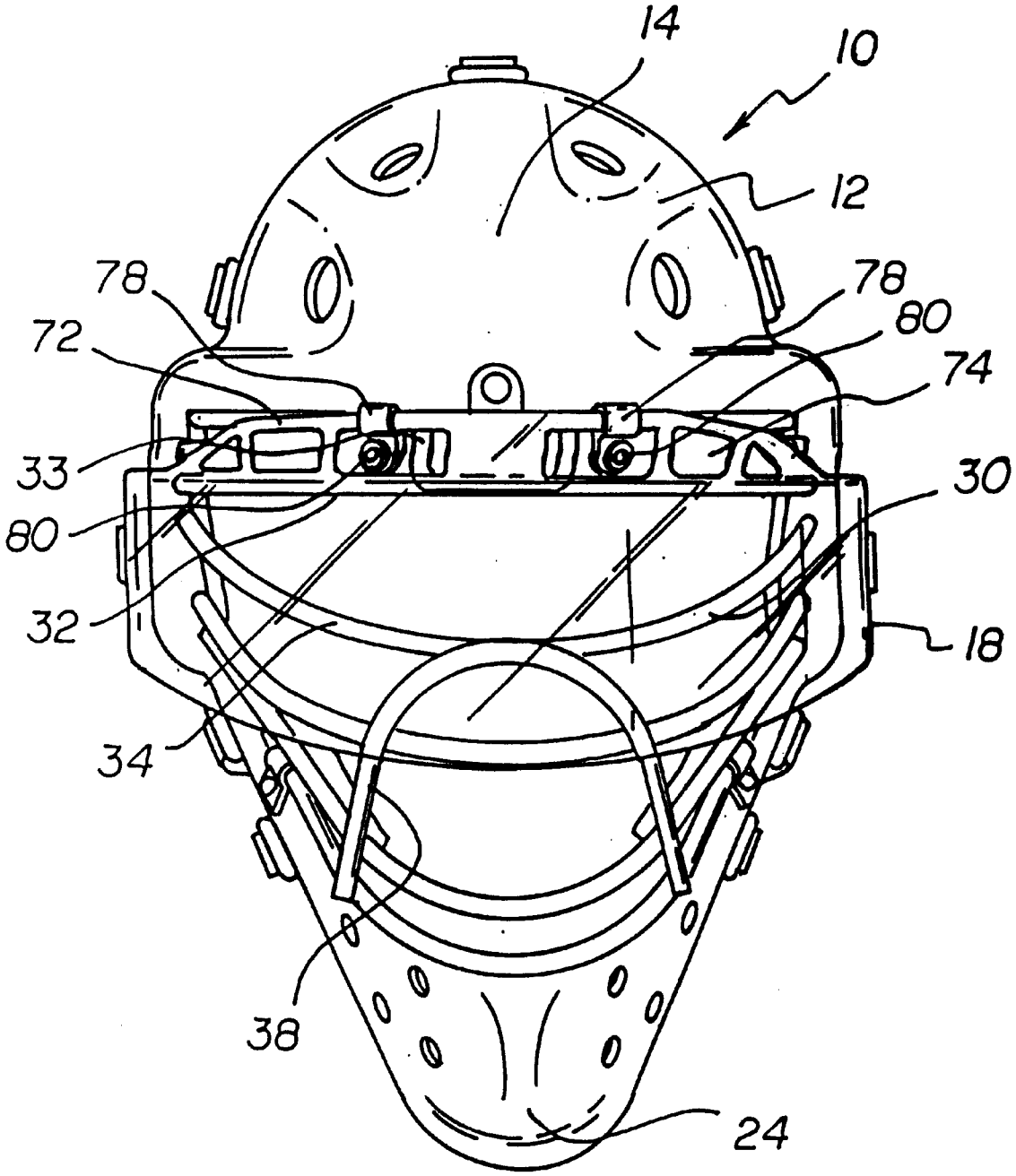
FIG. 1 is an illustration of the preferred embodiment of the catcher's helmet with eye shield constructed in accordance with the principles of the present invention.

With reference now to the drawings, and in particular to FIG. 1 thereof, a new and improved catcher's helmet embodying the principles and concepts of the present invention and generally designated by the reference numeral 10 will be described.

The present invention, the new and improved catcher's helmet, is comprised of a plurality of components. Such components in their broadest context include a front portion, rear portion and a plurality of straps formed there between and transparent shield positioned over the face opening. Such components are individually configured and correlated with respect to each other so as to attain the desired objective.

Figure 2:
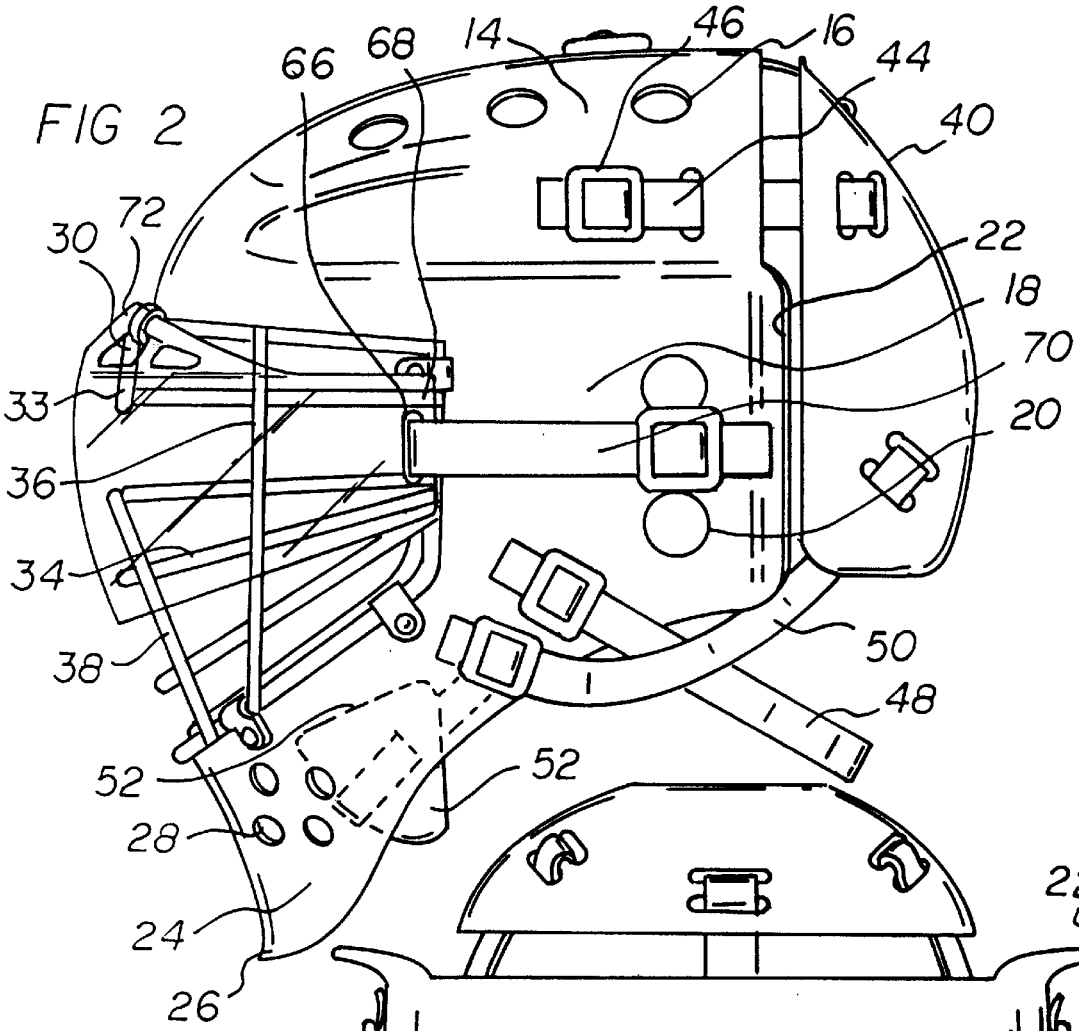
FIG. 2 is a side view of the present invention.
Figure 3:
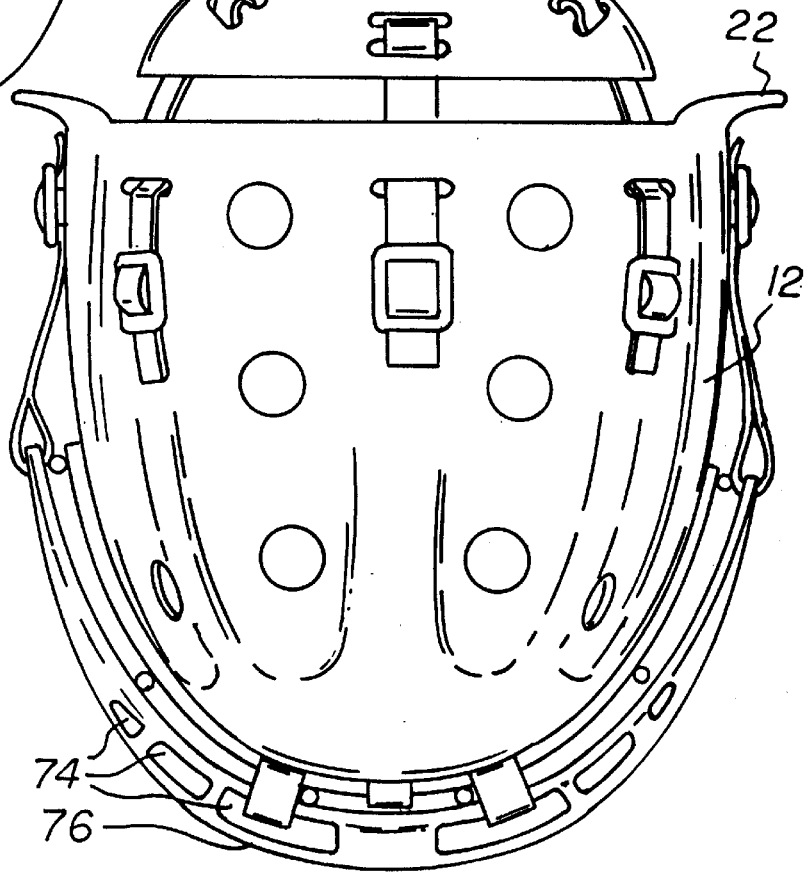
FIG. 3 is a top view of the present invention.

More specifically, it will be noted that the system 10 of the present invention includes a rigid unitary front portion 12 having a top extent 14. As shown in FIGS. 1 through 3, the top extent is defined by a quarter of an ellipsoid. The top extent is preferably of a length that is approximately equal to that of a head of a user. A pair of parallel rows of linearly aligned breathing apertures 16 are formed in the top extent between a front end and a rear end thereof. Specifically, the front portion includes two rows of four breathing apertures adjacent to and aligned with an apex of the top extent the front portion in addition to a pair of additional breathing apertures formed adjacent to a front of the top extent below the two rows.

The unitary front portion further includes a pair of generally planar and square side extents 18. The side extents are integrally coupled to a rear half of a lower peripheral edge of the top extent and depend downwardly therefrom. Each side extent includes a pair of vertically oriented apertures 20 formed therein, as shown in FIG. 2. The side extents each have an outwardly extending lip 22 formed along a rear edge thereof. See FIG. 3. As shown in FIGS. 2 & 3, the rear edges of the side extents reside in a vertical plane common to that which contains a rear edge of the top extent.

A front extent 24 of the unitary front portion has a pair of ends integrally coupled to lower front corners of the side extents. The front extent is defined by a top peripheral edge which resides in a plane extending forwardly and downwardly from the side extents at an angle of approximately 45 degrees. A lower peripheral edge of the front extent forms a smooth arcuate transition with that of the side extents. The front extent has a forwardly extending lip 26 and a plurality of breathing apertures 28 formed on each side thereof. In use, the front extent of the front portion serves to protect the neck and throat of a user.

Next provided is a face plate 30 including a pair of horizontally oriented upper U-shaped bars 32. Each of such upper U-shaped bars has ends mounted to tops of front edges of the side extents of the unitary front portion. The upper U-shaped bars are maintained in parallel relationship with each other via a front connector bar 33, as shown in FIG. 1.

A plurality of additional lower U-shaped bars 34 each have ends coupled to bottoms of the front edges of the side extents of the front portion at a common position. As such, the additional lower U-shaped bars extend therefrom at various angles between a horizonal and that associated with the top peripheral edge of the front extent of the unitary front portion. A pair of generally vertical side bars 36 are coupled along opposite sides of the upper and lower U-shaped bars. Furthermore, an inverted, vertically oriented U-shaped bar 38 is mounted to a front of the lower U-shaped bars. In the preferred embodiment, the bars of the face plate are fabricated of carbon steel and each has a diameter of 0.187 inches.

Also included is a rear portion 40 having an arcuate rear face and a peripheral side wall coupled to the rear face and extended forwardly therefrom. By this structure, the rear portion defines an open bottom 42 and a front peripheral edge which resides in a vertical plane. In use, the rear portion is shaped so as to work in conjunction with the front portion to encompass an entire head of a user. Preferably, a central aperture is formed in the rear portion for ventilation purposes.

A strap assembly includes a plurality of horizontally oriented adjustable straps 44 mounted between slots formed in a top extent of the unitary front portion and the rear portion. An adjustment buckle 46 is preferably situated between each pair of slots of the top extent of the unitary front portion. The horizontally oriented straps preferably include a top strap and a pair of side straps which reside adjacent to the lower peripheral edge of the top extent of the unitary front portion.

A pair of angled adjustable straps include a first angled strap 48 having ends coupled within angle slots in the front lower corners of the side extents of the front portion. As such, the first angled strap may be wrapped about a rear neck area of a user. A second angled strap 50 of the strap assembly has a pair of ends coupled within angled slots formed in the peripheral side wall of the rear portion. The second angled strap is slidably situated within angled slots formed in the front lower corners of the side extents. A chin holster 52 is in turn coupled to the second angled strap and is further situated within the helmet adjacent the front extent of the unitary front portion. Each of the straps of the present invention are preferably a cotton/elastic blend and the buckles are nylon.

Figure 4:
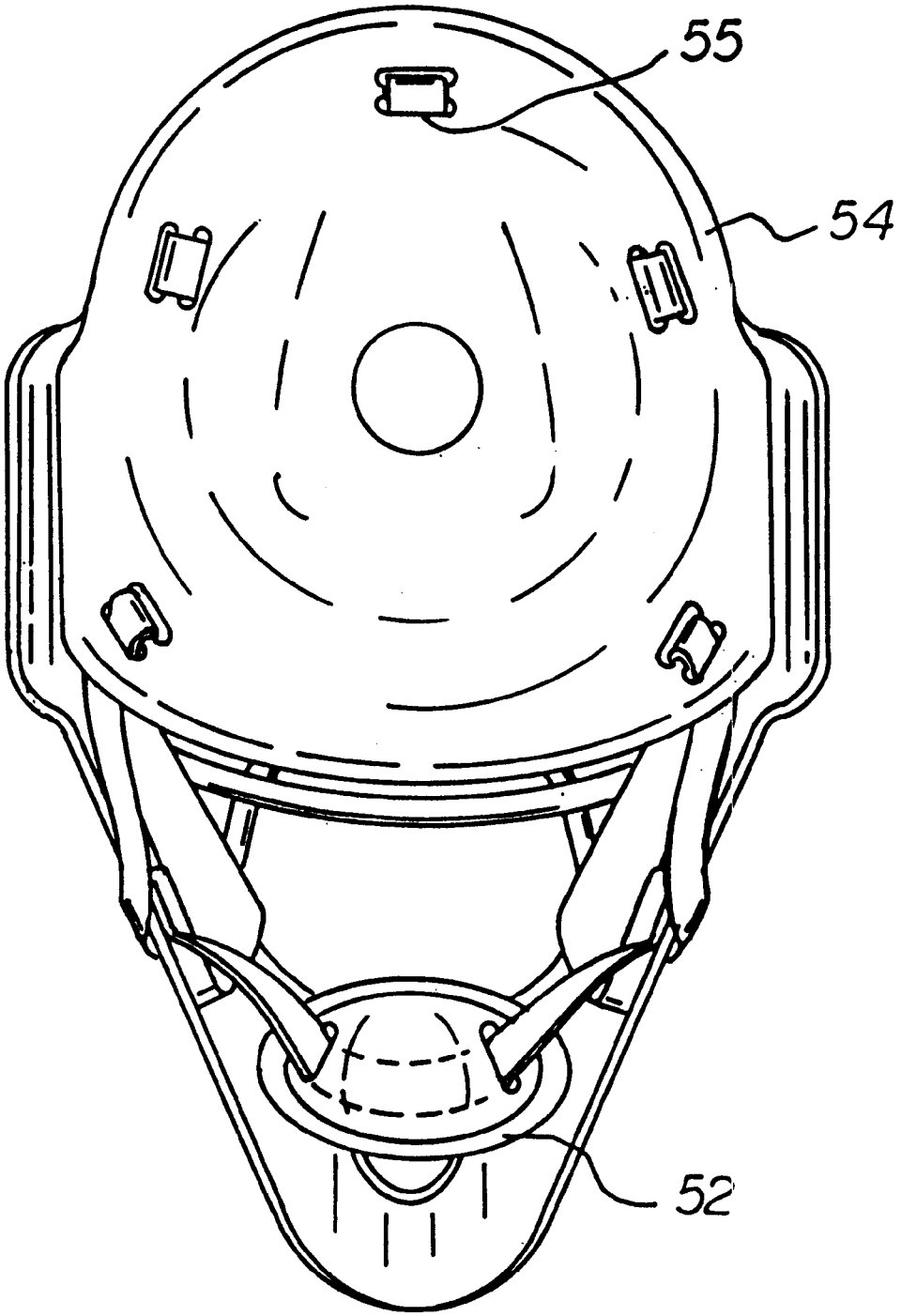
FIG. 4 is a rear view of the present invention.
Figure 5:
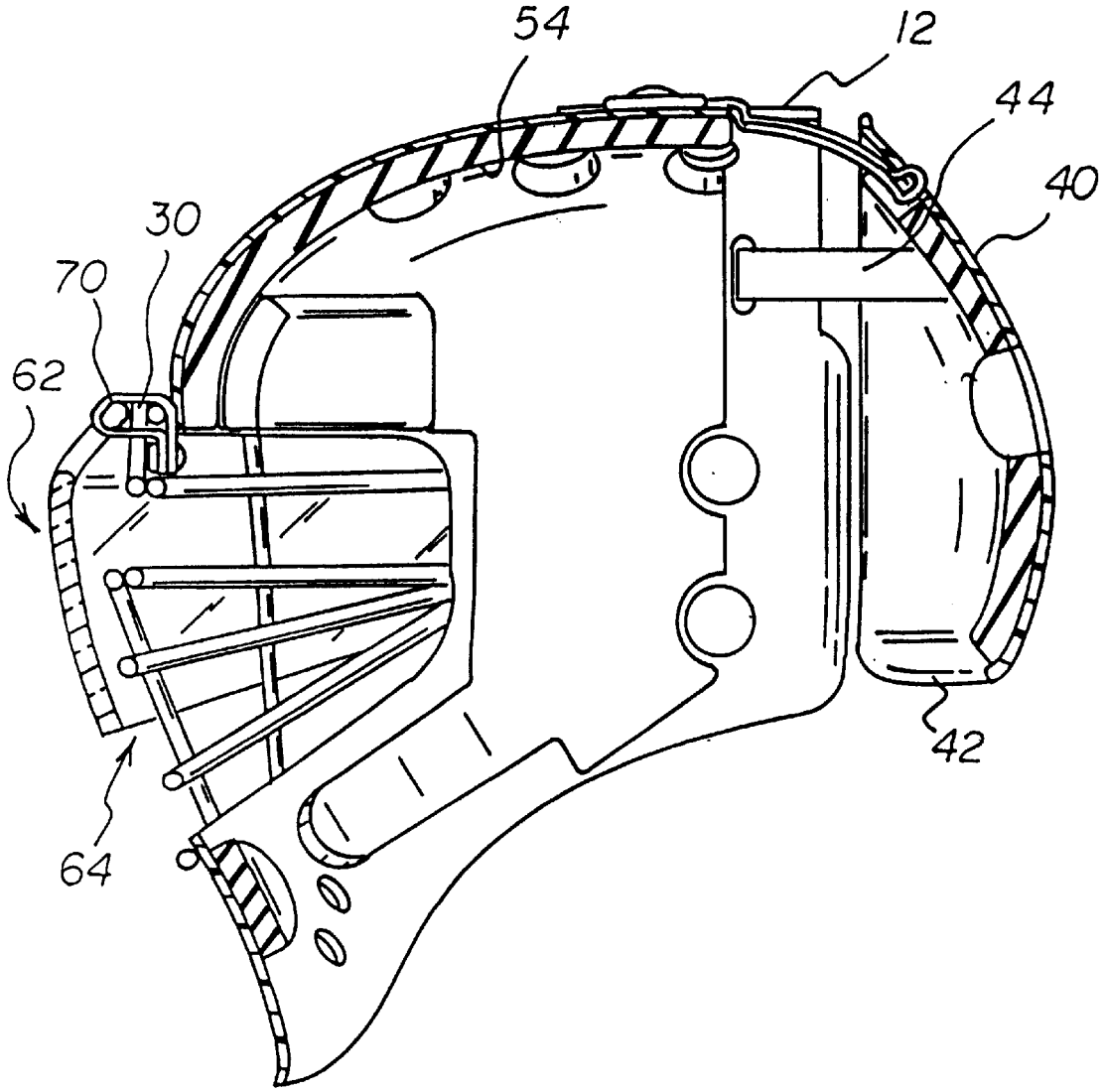
FIG. 5 is a side cross-sectional view of the present invention.

For affording comfort to a user, a pad 54 lines an interior surface of the front and rear portions. As shown in FIG. 4, the pad is also equipped with closely spaced slots 55 for receiving the aforementioned straps. As such, the pad may be removed and washed as desired. In the preferred embodiment, the removable pad is constructed from vinyl nitrile foam laminated to a thin layer of CoolMax® foam material. This composite configuration of foam aids in comfort protection and the whisking away and subsequent evaporation of perspiration from the user. In the alternative, the pad may be adhesively connected to the helmet. An additional rectangular pad lines an interior surface of the removable pad 54. Such additional rectangular pad preferably is constructed from a CoolMax® foam material.

Preferably, the front and rear portions are either injection molded or constructed from a vacuum formed mold with a thickness of 0.150"+/−0.030". For affording additional strength, nylon which takes the form of chopped fibers is include in the mold. An ideal material with such characteristics is STAPRON™ nylon 6 fiberglass reinforced, toughened. It should be noted, however, that the fiber may be excluded for ideal impact resistance, as in a polymer matrix similar to PREVAL 187™. Given the foregoing construction, the helmet of the present invention is capable of weighing about 2.6 pounds. In order to add a finishing color to the helmet shell, it could be painted with an acrylic enamel or more preferably, pigment could be added to the resin during the injection molding process.

The present invention also includes a shield. The shield is positioned over the upper extent of the face opening 62 of the mask to cover the majority of the area thereof between the side extents and from the top extent to a location 64 adjacent to but above the front extent. The shield is fabricated of a rigid transparent plastic material which can be tinted to reduce glare. The shield also includes vertical slots 66 adjacent to its lateral ends 68 for the receipt of coupling straps 70. Further provided is an upward, inwardly angled joining region 72, the joining region being formed with a plurality of small opening 74 to define a plurality of reception rods 76 along the upper extent. Straps 78 encompass the rods for joining the rods and the shield to the mask through fasteners 80. This interconnection allows the shield to be pivoted upwardly relative to the mask. Namely, the rods and eye shield are adapted to pivot within the straps 78. The weight of the helmet with the shield includes is 2 pounds 11 ounces.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A catcher's helmet comprising, in combination:

a rigid unitary front portion including a top extent defined by a quarter of an ellipsoid and having a pair of parallel rows of linearly aligned breathing apertures formed therein between a front end and a rear end thereof, the unitary front portion further including a pair of generally planar and square side extents integrally coupled to opposite sides of a rear half of a lower peripheral edge of the top extent and depending downwardly therefrom with each side extent including a pair of vertically oriented apertures formed therein, the side extents each having an outwardly extending lip formed along a rear edge thereof, the unitary front portion further including a front extent having a pair of ends integrally coupled to lower front corners of the side extents and extending forwardly therefrom, the front extent defined by a top peripheral edge which resides in a plane extending forwardly and downwardly from the side extents and a lower peripheral edge forming a smooth arcuate transition with that of the side extents, the rear edges of the side extents residing in a vertical plane common to that which contains a rear edge of the top extent, wherein the front extent has a forwardly extending lip and a plurality of breathing apertures formed therein, with a face opening located between the top extent, side extents and front extent;

a face plate including a pair of horizontally oriented upper U-shaped bars each having ends mounted to tops of front edges of the side extents of the unitary front portion in parallel relationship with each other, a plurality of additional lower U-shaped bars each having ends coupled to bottoms of the front edges of the side extents of the front portion at a common position such that the additional lower U-shaped bars extend therefrom at various angles between a horizontal plane and that associated with the top peripheral edge of the front extent of the unitary front portion, a pair of generally vertical side bars coupled along opposite sides of the upper and lower U-shaped bars, and an inverted vertically oriented U-shaped bar mounted to the lower U-shaped bars;

a rear portion including an arcuate rear face and a peripheral side wall coupled to the rear face and extended forwardly therefrom for defining an open bottom and a front peripheral edge which resides in a vertical plane;

a strap assembly including a plurality of horizontally oriented adjustable straps mounted between slots formed in a top extent of the unitary front portion and the rear portion and a pair of angled adjustable straps including a first angled strap having ends coupled within angle slots in the front lower corners of the side extents of the front portion such that the first angled strap may be wrapped about a rear neck area of a user and a second angled strap having a pair of ends coupled within angled slots formed in the peripheral side wall of the rear portion and having a midpoint slidably situated within angled slots formed in the front lower corners of the side extents such that a chin holster is coupled to the second angled strap and situated within the helmet adjacent the front extent of the unitary front portion; and a pad lining an interior surface of the front and rear portions; and a shield positioned over the upper extent of the face opening of the mask to cover the majority of the area thereof between the side extents and from the top extent to a location adjacent to but above the front extent, the shield being fabricated of a rigid transparent plastic material with vertical slots adjacent to its lateral ends for the receipt of coupling straps and with an upward, inwardly angled joining region, the joining region being formed with a plurality of small openings to define a plurality of reception rods along the upper extent and with straps encompassing the rods for joining the rods and the shield to the mask through fasteners.

* * * * *